United States Patent [19]

Begon

[11] Patent Number: 4,890,390

[45] Date of Patent: Jan. 2, 1990

[54] SWORD BLADE

[75] Inventor: Jean A. Begon, Loire, France

[73] Assignee: Begon S.A., Loire, France

[21] Appl. No.: 186,258

[22] Filed: Apr. 25, 1988

[30] Foreign Application Priority Data

Apr. 23, 1987 [FR] France ..... 87 06042

[51] Int. Cl.[4] ..... F41B 13/02

[52] U.S. Cl. ..... 30/346; D22/118

[58] Field of Search ..... 30/346, 165, 164.5, 30/164.8, 366, 353; D22/118; 272/98

[56] References Cited

FOREIGN PATENT DOCUMENTS 2535037 4/1984 France .
439666 5/1984 France .
WO86/06825 11/1983 PCT Int'l Appl. .

*Primary Examiner*—Donald R. Schran
*Assistant Examiner*—Y. Lin
*Attorney, Agent, or Firm*—Browdy and Neimark

[57] ABSTRACT

A sword blade is formed of a rib (3) connected by stress concentration studs (19) to a pair of extension strips (2), so that the moment of inertia of the cross section of the rib, with respect to a plane of inertia (x'-x) passing through the concentration studs, is equal that of the strips, all along the length of the sword. The concentration studs concentrate stress in the blade and are deformed and break, thus alerting the user to discard the sword, end faces (10*b*, 14*a*) of the rib and extension strips are formed parallel to the plane of inertia, for distribution stress across these faces, to prevent the starting of cracks causing the sword to break.

8 Claims, 1 Drawing Sheet

SWORD BLADE

BACKGROUND OF THE INVENTION

Traditionally, sword blades have a cross section with a shape like a circumflex accent, as represented in FIG. 1, and the dimensions of the cross section diminish from the tang to the tip of the blade.

When this circumflex accent section is examined in regard to the strength of the materials, and relative to a plane x'-x comprising the neutral axis and separating part 2 of the blade working under extension, i.e., the wings, from the part working under compression, i.e., rib 3, it is found that the surface of the former, i.e. part 2, is greater than that of the latter, i.e. rib 3, which leads to different moments of inertia. It is also found that a "neutral zone" shown hatched in FIG. 1, i.e., the less stressed zone, comprises much material uselessly adding to rhe weight of the blade.

Another drawback of this circumflex accent cross section is the presence at the ends of wings 2 of the edges 4 which undergo the highest tension stresses and thus, when the metal reaches a high level of fatigue, favor the start of cracks which can start the crosswise breaking of the blade.

Finally, a very considerable economic drawback is involved, since the circumflex accent section combined with the variations in dimensions in the various cross sections require the blade to be made by hand, because of the absence of any reference surface allowing mechanization of its production.

SUMMARY OF THE INVENTION

The object of the invention is to provide a new sword blade section eliminating the concentrations of stresses on the edges, lightening the blade, and making possible its production by industrial means and at less cost.

For this purpose, the sword blade, according to the invention, exhibits in cross section, at all points along its length, a shape whose moments of inertia, relative to a plane of inertia containing a neutral axis extending along the blade, are approximately equal. This shape is made up, on the one hand, in the rib working in compression, of a polygonal elementary section exhibiting at least two faces parallel to the plane of inertia, and two lateral faces perpendicular thereto, and, on the other hand, wings working in tension are made up of two further elementary sections, equally spaced on both sides of a vertical median plane of the blade. Each of the two further elementary sections has a polygonal shape exhibiting at least two faces parallel to the plane of inertia, and two lateral faces perpendicular thereto. The two further elementary sections constitute, over the length of the blade, extension strips which are each connected to the rib by studs for concentration of the stresses, and for accumulating the fatigue resulting from the stresses on the blade. The studs are located so as to be intercepted by the plane of inertia.

Thus, the blade is made up of a rib of polygonal section connected by stress studs to the two spaced extension strips, the sum of whose moments of inertia relative to the plane of inertia is equal to the moment of inertia of the rib in the same cross section.

Consequently, during assaults and combat, the stresses affecting the blade, on the one hand, are distributed uniformly over the plane faces parallel to the plane of inertia and, on the one hand, are transmitted in part to the stress concentration studs which perform a function of recording and accumulating the fatigue of the material of the blade. Beyond a certain fatigue value, the most affected studs give way, thereby informing the user that the blade must be scraped and avoiding the breaking of the blade, which is dangerous for the adversary.

Finally, thanks to the presence of parallel faces on the various elementary sections of the blade, production of the latter can be performed industrially by machines with numerical control machining, which makes it possible by complete automation of machining phases to lower the production cost, and to obtain perfect reproducibility of shapes and dimensions.

In an embodiment of the invention, the stress concentration studs connecting the various elementary sections of the blade are delimited by machining performed in the two ribs, the two ribs being arranged in a V relative to one another, each connecting the rib to one of the extension strips and having a rectangular cross section.

Because of this, the blade exhibits in cross section a V shape, which gives it a general shape similar to that of a traditional sword although it is distinguished by superior qualities.

Advantageously, the machinings delimiting the stress concentration studs consist of two superposed longitudinal rows of oblique holes offset with respect to each other and at a constant pitch. Each row is parallel to the longitudinal axis of the blade and there is a pair of rows on each side of the longitudinal axis, the holes of one of the rows being offset relative to those of the other row.

Other characteristics and advantages are present as seen from the following description with reference to the accompanying schematic drawings, representing by way of nonlimiting examples two embodiments of the sword blade of the present invention.

DESCRIPTION OF PREFERRED EMBODIMENTS

Figure 2:
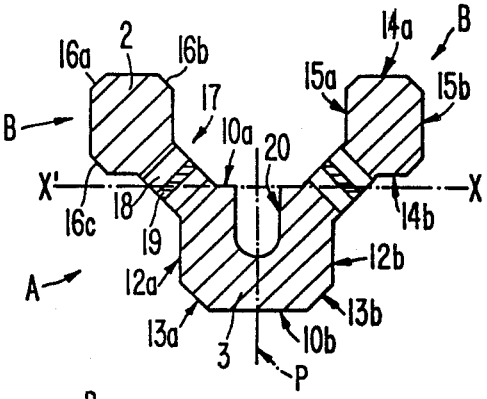
FIGS. 2 and 3 are views in cross section of two spaced sections of the blade according to the invention.
Figure 3:
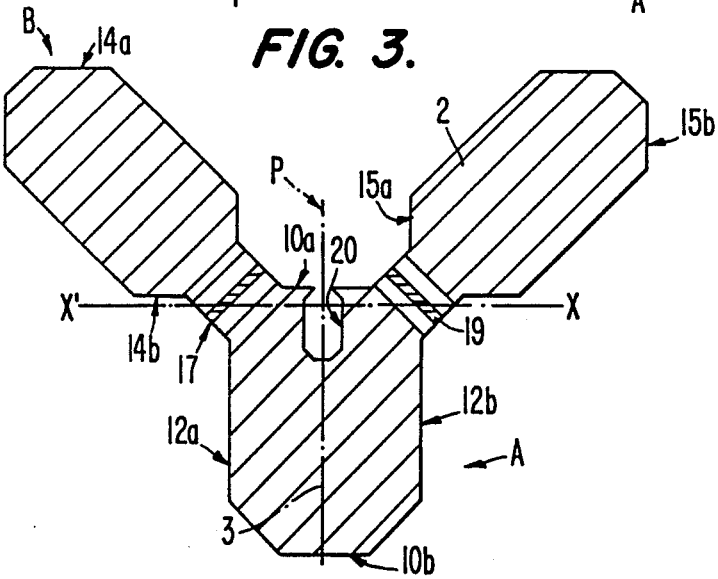

In FIGS. 2 and 3, a sword blade according to the invention exhibits in cross section a shape made up a rib 3 with an elementary section A and the wings 2 with elementary sections B.

Elementary section A exhibits a polygonal shape comprising two faces **10*a*, 10*b* parallel to one another and to a plane of inertia x'-x, and two lateral faces 12*a*, 12*b* arallel to one another and perpendicular to said faces 10*a*, 10B and to the plane of inertia x'-x. Elementary section A also comprises, on both sides of face 10b, two inclined crosswise faces 13*a*, 13*b* at the end of the rib 3** at the front of the sword.

Each of elementary sections B also exhibits a polygonal shape delimited by two plane faces **14*a*, 14*b* parallel to one another and parallel to the plane of inertia x'-x, by two lateral plane faces 15*a*, 15*b* and by inclined faces 16*a*, 16*b*, 16*c*** delimiting bevels on each of the extension strips of section B thus formed.

Each of the elementary sections B is connected to the elementary section A by a rib generally designated by 17. FIGS. 2 and 3 show that these ribs form a regular V on both sides of the vertical median plane P of the blade, and that they are cut by the plane of inertia x'-x. More precisely, these ribs 17 comprise machinings 18 delimiting between them stress concentration studs 19 for accumulating the fatigue resulting from stresses exerted on the blade. These stress concentration studs 19 are able to give way beyond a certain value of this fatigue.

Figure 4:
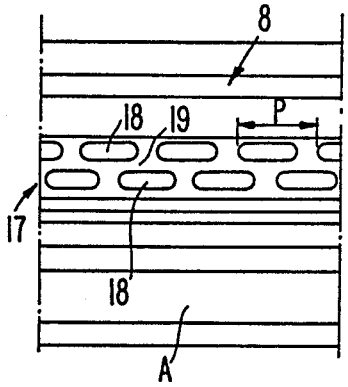
FIG. 4 is a partial side view along one diagonal edge in FIG. 2.

FIG. 4 shows that machinings 18 can be formed to consist of two superposed longitudinal rows of oblong holes. The two rows are placed parallel to a longitudinal axis of the blade and on both sides of this axis. In each row, the holes 18 are distributed with a constant pitch p, and the holes of one of the two rows are offset by a half pitch relative to those of the other row, to this constitute small stubs 19 of lesser dimension, which are able to give way of a certain fatigue value, since the plane of inertia x'-x cuts through the studs 19.

In a known way, elementary section A comprises an inside groove 20, which is for receiving an electric conductor for detecting touches during combat.

Figure 1:
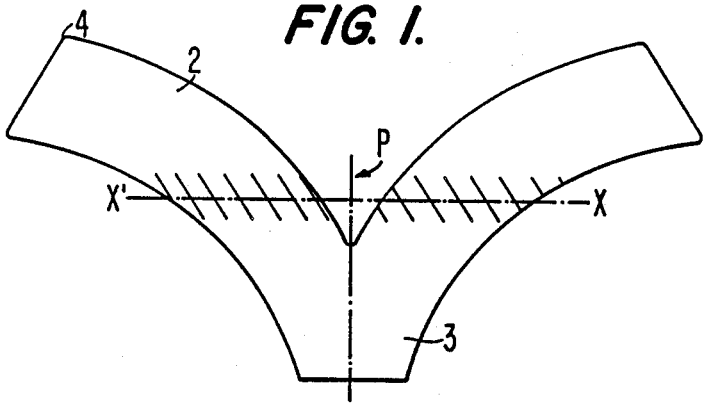
FIG. 1 is a view in cross section of a traditional sword blade.

FIGS. 2 and 3, corresponding to two cross sections placed close to the tip and tang, respectively, of the blade, show indeed that, despite the dimensional variations of the elementary sections of the blade, this balde preserves, over its entire length, plane faces 10*a*, 10*b*, 12*a*, 12*b*, 14*a*, 14*b*, 15*a*, 15*b*. This makes possible its machining by current or automated machine tools, which was not the case with blades comprising the section represented in FIG. 1.

This mode of machining makes it possible, as required, to cause the dimensions of the elementary cross section to vary and thus to cause the rigidity of the blade, and the position of the flexible zones, to vary, therefore to adapt the blade to the desires of the user. This advantage, which is new relative to forged blades having irregular characteristics, is reproducible from one blade to the next, since it depends only on the crosswise dimensions given to the blade by the machining. Further, it makes it possible to make an entire series of blades differing by their length, their flexibility, and the position of the flexible zones, but with each having reproducible and therefore standarized characteristics.

Further, during combat, the extension and compression stresses, due to the impacts on the blade, can be prevented from being concentrated in the edges, and instead are distributed over the plane surfaces 14a and 10b, and eventually over surface 15*a*, which eliminates any possibility of concentration of stresses favoring the start of cracks when the blade reaches a considerable level of fatigue. On the other hand, the fatigue is concentrated in part in studs 19 which, starting from a given level of fatigue, and depending not only on the characteristics of the metal used but also on the position of the section considered over the length of the blade, give way assuring the local separation of one of the strips relative to the rib, which warns the user that the blade should be scrapped.

It should also be noted that, thanks to the presence of ribs 17 connecting the lateral strips to the rib, the blade has little material on both sides of the plane of inertia x'-x and therefore is lighter than a traditional blade.

Although they can be made in any other way, holes 18 are advantageously made by laser machining.

The foregoing description of specific embodiments fully reveal the general nature of the invention so that others can, by applying current knowledge, readily modify and/or adapt for various applications such specific embodiments without departing from the generic concept. Therefore, such adaptations and modifications should and are intended to be comprehended within the scope of the present invention, and within the meaning and range of equivalents of the disclosed embodiments. It is to be understood that the phraseology or terminology employed herein is for the purpose of description and not of limitation.

What is claimed is:

1. A sword blade comprising a longitudinal member which comprises, in cross section at each point along its length, a first part and second part connected together and being located effectively on respective opposite sides of a plane of inertia of the blade transverse to the cross section and containing a neutral axis of the blade, said first part having a moment of inertia with respect to said plane of inertia that is approximately equal to the respective moment of inertia of said second part, said first part including a rib having a polygonal elementary section with at least two first faces oriented parallel to said plane of inertia, and two first lateral faces oriented perpendicular to said two first faces, said second part including a pair of wings of two further elementary sections, said further elementary sections being equally spaced on both sides of a vertical median plane of the blade perpendicular to said plane of inertia, each said further elementary section having a polygonal shape with at least two second faces parallel to said plane of inertia and two second lateral faces perpendicular to said two second faces, each said wing thus constituting an extension strip extending along said rib for the length of the blade, and stress concentration means for concentrataion of stresses at a plurality of points in the blade along the length thereof, and for accumulating fatigue from said stresses, a first plurality of points of said stress concentration means connecting said rib and the first of said wings, and a second plurality of points of said stress concentration means connecting said rib and the second of said wings, each said stress concentration means being placed at respective points along the length of the blade so as to be intersected by said plane of inertia for the respective cross section.

2. The blade of claim 1, said two extension strips extending from said rib to form a V-haped cross section of the blade, each said extension strip including a respective one of said wings, wherein said stress concentration means are formed by machinings formed in said two extension strips, each said stress concentration means having a rectangular cross section.

3. The blade of claim 2, wherein said machinings for forming said stress concentration means comprise two superposed longitudinal rows of oblique holes formed at a constant pitch and oriented parallel to a longitudinal axis of the blade and on both sides thereof, said holes of a first one of said rows being offset relative to those of the other.

4. The blade of claim 1, each of said polygonal elementary section and further elementary sections comprising a respective pair of first faces oriented parallel to said plane of inertia, and a second respective pair of faces oriented perpendicularly to said plane of inertia, wherein stresses in the blade along its length are distributed across two maximally separated ones of said first faces on opposite sides of said plane of inertia, said two maximally separated faces including one of said first faces of said polygonal elementary section and one of said first faces of each said further elementary section.

5. The blade of claim 1, said rib comprising a respective part extending on the same side of said plane of inertia as said second part of the blade, said respective part including one of said first faces of said polygonal elementary section, wherein a groove is formed in said rib to extend the length of the blade, said groove being formed to extend from said one first face into said rib.

6. The blade of claim 1, wherein it is designed for said rib with said polygonal elementary section to be working effectively in compression and for said wings with said further elementary sections to be working in tension.

7. The blade of claim 1, having mirror symmetry with respect to a plane extending through a mid-plane of said rib and perpendicular to the plane of inertia at each cross section along the length of the sword.

8. The blade of claim 3, having mirror symmetry with respect to a plane extending through a mid-plane of said rib and perpendicular to the plane of inertia at each cross section along the length of the sword.

* * * * *